US005788422A

United States Patent [19]

Gardner et al.

[11] Patent Number: 5,788,422

[45] Date of Patent: Aug. 4, 1998

[54] UNDERGROUND BARRIER CONSTRUCTION APPARATUS WITH SOIL-RETAINING SHIELD

[75] Inventors: Bradley M. Gardner, Idaho Falls; Ann Marie Smith, Pocatello, both of Id.; Richard W. Hanson, Spokane; Richard T. Hodges, Deer Park, both of Wash.

[73] Assignee: Lockheed Martin Idaho Technologies Company, Idaho Falls, Id.

[21] Appl. No.: 725,448

[22] Filed: Oct. 4, 1996

[51] Int. Cl.[6] ..... E02D 3/12; E02D 5/18; E02F 5/06

[52] U.S. Cl. ..... 405/267; 37/462; 405/129; 405/240; 405/268

[58] Field of Search ..... 405/128, 129, 405/233, 240, 266, 267, 268; 37/189, 190, 462, 463, 464, 465; 588/259

[56] References Cited

U.S. PATENT DOCUMENTS

| | | | |
|---|---|---|---|
| 4,092,536 | 5/1978 | Smith | 250/265 |
| 4,697,953 | 10/1987 | Nussbaumer et al. | 405/128 |
| 4,877,358 | 10/1989 | Ressi Di Cervia | 405/267 |
| 5,118,230 | 6/1992 | Justice | 405/128 |
| 5,246,312 | 9/1993 | Taki | 405/267 |
| 5,311,683 | 5/1994 | Camiller | 405/267 X |
| 5,542,782 | 8/1996 | Carter, Jr. et al. | 405/129 |
| 5,599,139 | 2/1997 | Chenning et al. | 405/129 |

*Primary Examiner*—George A. Suchfield
*Attorney, Agent, or Firm*—Thorpe North & Western

[57] ABSTRACT

An apparatus for building a horizontal underground barrier by cutting through soil and depositing a slurry, preferably one which cures into a hardened material. The apparatus includes a digging means for cutting and removing soil to create a void under the surface of the ground, a shield means for maintaining the void, and injection means for inserting barrier-forming material into the void. In one embodiment, the digging means is a continuous cutting chain. Mounted on the continuous cutting chain are cutter teeth for cutting through soil and discharge paddles for removing the loosened soil. This invention includes a barrier placement machine, a method for building an underground horizontal containment barrier using the barrier placement machine, and the underground containment system. Preferably the underground containment barrier goes underneath and around the site to be contained in a bathtub-type containment.

19 Claims, 10 Drawing Sheets

UNDERGROUND BARRIER CONSTRUCTION APPARATUS WITH SOIL-RETAINING SHIELD

CONTRACTUAL ORIGIN OF THE INVENTION

The United States Government has rights in this invention pursuant to Contract No. DE-AC07-94ID13223 between Lockheed Martin Idaho Technologies Company and the United States Department of Energy.

BACKGROUND OF THE INVENTION

1. Field of the Invention

The present invention relates generally to a device and method for building an underground barrier. More particularly, this invention is directed to constructing a containment barrier underneath and around a hazardous waste site.

2. Background Art

It is often necessary to form a containment barrier around a hazardous waste site to stop or prevent the migration of contaminants into the nearby soil and water tables. The containment barrier must prevent the migration of contaminants both horizontally and vertically away from the waste site. Therefore, a properly constructed containment barrier may be compared to a huge bathtub, with the hazardous waste contained within four side walls and a generally horizontal floor.

A present method is to physically remove the hazardous waste and haul it to a permitted storage facility. However, such method is costly, impractical, and dangerous. Digging up sites with buried drums, radioactive dusts, or other airborne wastes may actually release the contaminants, spreading them into the atmosphere and through the soil.

In response, researchers at Halliburton Nus Environmental Corp. have developed an apparatus and method to place a containment barrier around a hazardous waste site, as shown in International Publication Nos. WO 94/19547 and WO 93/00483. The Halliburton system uses a row of high pressure jets to shoot a slurry into the soil surrounding a hazardous waste site, somewhat liquefying the surrounding soil. The slurry cuts a path through the soil as it intermixes with the liquified soil. Gravity and/or mechanical means pull the row of high pressure jets through the mix of liquified soil and slurry. The liquified soil and slurry then harden into a protective barrier.

Although the Halliburton system has promise for some applications, it has several shortcomings that limit its use. First, the use of hydraulic jets may introduce liquids that can further spread contaminants. Second, because the system uses the same slurry for both cutting and mixing, in many applications there may be an imbalance between the amount of slurry needed for cutting and the amount of slurry needed for hardening the soil. Third, the hydraulic jets may only work in sandy or soft soils and may not work in rocky or hard soils.

Fourth, in the Halliburton system, the slurry is not controlled as it is deposited. Since the slurry mixes with the liquefied soil, the strength of the barrier depends on the soil composition encountered. Too little slurry may be deposited where the soil is easily cut. Excess slurry may be deposited where the soil is difficult to cut. Weak spots will form in the containment barrier if the soil contains air cavities or mixed pockets of soft and hard materials. The location of such weak spots is unpredictable. Those using the Halliburton system have no way of knowing when and where such weak spots will be.

Finally, the Halliburton system does not allow for periodic testing of the excavated soil. An environmental engineer, placing a containment barrier, often needs to know whether the soil displaced by the containment barrier is contaminated. Since, with the Halliburton system, the soil remains buried deep underground mixed with slurry, relevant soil samples appear to be inaccessible.

OBJECTS AND SUMMARY OF THE INVENTION

An object of the invention is to provide a means for building a containment barrier for a hazardous waste site without disturbing any buried waste.

Another object of the invention, in accordance with one aspect thereof, is to provide a means for building a horizontal containment barrier under a hazardous waste site without disturbing any buried waste.

A further object of the invention is to provide a less expensive and simpler means for building a containment barrier for a hazardous waste site.

An additional object of the invention, in accordance with one aspect thereof, is to provide a means for simultaneously building the sides and the horizontal floor of a containment barrier.

A further object of the invention is to provide a containment barrier having enhanced, reinforced strength.

An even further object of the invention is to provide a containment barrier capable of resisting radiation.

Another object of the invention is to provide a barrier placement means that allows the displaced material to be tested periodically for contaminants and for soil composition and structural strength.

The above objects and others not specifically recited are realized in a specific illustrative embodiment of an apparatus for building an underground containment barrier. The barrier is composed of a material, such as concrete, that initially is a slurry that flows into an open space, yet over time will cure into a solid mass having generally the shape of the open space. The apparatus includes a horizontally-disposed digging means for cutting and removing soil to create a void under the surface of the ground, a shield means for maintaining the horizontal void, vertically-disposed side trench excavators for digging open side trenches and sequentially moveable side shields for maintaining the open side trenches, and injection means for inserting the slurry into the voids.

The digging means leaves the void enclosed by an upper and lower planar soil wall, both soil walls formed by the remaining soil surrounding the void. The upper and lower walls are generally parallel to each another.

The horizontal shield means maintains the horizontal void by supporting the upper soil wall surrounding the void. The horizontal shield means is affixed to the digging means so the shield means is in place to maintain the horizontal void as soon as said digging means has created said horizontal void. The horizontal shield means maintains the void while the slurry is inserted thereinto, preferably maintaining the horizontal void until the slurry develops an initial set.

The digging means, the horizontal shield means, and injection means are affixed in place with respect to each other. The digging means continually creates a void, the horizontal shield means continually maintains the void until the slurry fills the void, and the injection means continually inserts the slurry into the void, all operating in tandem simultaneously with each other, thus continually creating the underground barrier.

In one embodiment, the digging means is a continuous cutting chain. The continuous cutting chain is suspended taunt between a drive means and an idler means so the continuous cutting chain forms a first longitudinal portion and a second longitudinal portion between the drive means and the idler means. The first and second portion are generally parallel to the each other. The drive means rotates the chain so any point on the continuous cutting chain continually rotates through the first longitudinal portion and through the second longitudinal portion, turning at the idler means and at the drive means. The first longitudinal portion is held against the soil.

Mounted on the continuous cutting chain are a plurality of cutter teeth for cutting through soil. As the continuous cutting chain rotates, the cutter teeth in the first longitudinal portion dig into the soil, breaking the soil into loose soil. Also mounted on the continuous cutter chain is a plurality of discharge paddles for removing the loosened soil. The discharge paddles are interspersed between the cutter teeth. As the cutting chain rotates, the discharge paddles in the first longitudinal portion scoop up the loose soil, pushing it away from the first longitudinal portion to create a void under the surface of the ground.

In another embodiment, the digging means can be a jet grouting system. In one embodiment, the jet grouting system supplements the continuous cutting chain. In hard soil, the continuous cutting chain cuts through the hard soil. The jet grouting system follows to further cut through the soil and to deposit grout into the cleared void.

An embodiment of this invention includes a barrier placement machine for building an underground horizontal containment barrier at a selected level below the surface of the ground. The barrier placement machine includes a left trench excavator means for digging a left side trench and a right trench excavator means for digging a right side trench. The left and right side trench are open ditches with a depth extending from the surface of the ground to the selected level below the surface of the ground.

A main frame between the left and right trench excavator means holds the left and right trench excavator means a fixed distance apart so the left and right side trenches will be dug parallel to each other. A track means supports the main frame off the ground and can move the main frame in a desired direction of travel. The barrier placement machine also includes a digging means for cutting and removing soil to create an essentially horizontal underground void between the two side trenches and an injector means for inserting the slurry into the horizontal void to produce the underground horizontal containment barrier.

This invention includes a method for building an underground horizontal containment barrier using the barrier placement machine. Left and right parallel side trenches are dug. A rear trench between the two parallel side trenches is dug, with the rear trench being opposite of the selected direction of travel of the barrier placement machine. The left trench excavator means is placed in the left side trench. The right trench excavator means is placed in the right side trench. The main frame is placed between the left and right trench excavator means. The horizontal digging means is placed in the rear trench between the two parallel side trenches. The barrier placement machine moves forward in the selected direction of travel, extending the parallel left and right trenches, and simultaneously laying a generally horizontal concrete barrier within the horizontal void between the left and right trenches as well as forming left and right side barriers in the side trenches.

A front trench is dug in front of, and perpendicular to, the selected direction of travel of the barrier placement machine so when the barrier placement machine intercepts the front trench, the front trench extends between the two side trenches. When the barrier placement machine reaches the front trench, the main frame is disassembled and removed. The left and right trench excavator are removed from the left and right trenches, and the digging and injector means are removed out through the front trench. Barriers are constructed in the rear and front trenches, using conventional methods, to complete the construction of an underground containment barrier.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
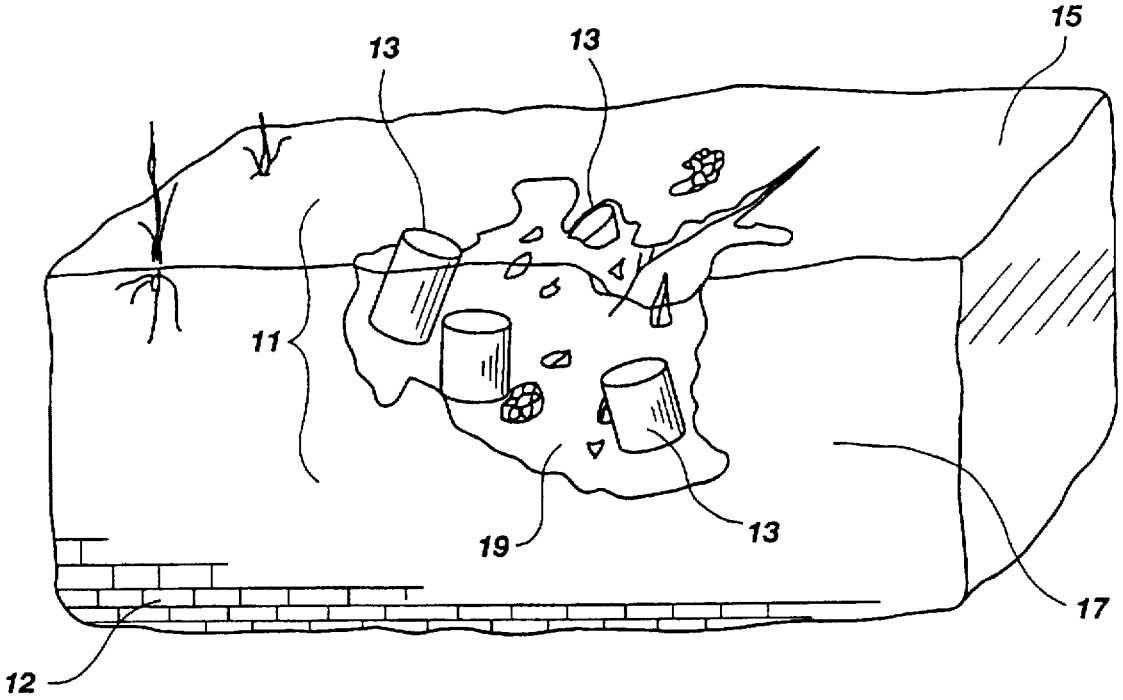
FIG. 1 is a perspective view of a piece of ground contaminated by hazardous waste.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicants have discovered that hazardous waste can be contained more effectively by encapsulating the waste site with a large container, preferably made from grout or other cementitious material, without moving or disturbing the waste. Conventional methods of removing the waste to some other site, or forming a containment barrier by intermixing grout with the native soil surrounding the waste, are less effective in minimizing the risks associated with disturbing the waste and failing to seal the waste properly. Applicants' method subsists in actually forming a containment barrier beneath and around the waste site to encapsulate the waste with independently-formed barrier walls, without moving or even disturbing the waste, and preferably without using the native surrounding soil as part of the barrier-forming material.

The further concepts of the present invention include a preferred method for containing an in-situ waste site disposed within earthen material, said method comprising the steps of:

(a) excavating a generally horizontal trench beneath the in-situ waste site substantially without disturbing said in-situ waste site and thereby forming a generally horizontal underground trench defined by opposing earthen sidewalls;

(b) forming a generally horizontal barrier within the horizontal trench;

(c) excavating side trenches continuously surrounding the entire in-situ waste site such that said side trenches are disposed in communication with the horizontal trench;

(d) forming interconnected side barriers within the side trenches such that said side barriers continuously surround the waste site and form a continuous upper perimeter;

(e) interconnecting the side barriers with the horizontal barrier such that said horizontal and side barriers cooperatively form a one-piece unitary barrier enclosure.

The above-described method may be enhanced by augmenting steps (c) and (d) in simultaneously excavating side trenches and forming side barriers within said side trenches by the incremental steps of:

(f) excavating a first side trench portion;

(g) excavating a second side trench portion while reinforcing the first side trench portion against collapse;

(h) excavating a third side trench portion while reinforcing the second side trench portion against collapse and forming a side barrier portion within the first side trench portion;

(i) selectively and incrementally repeating steps (f), (g) and (h) until a side trench and side barrier of predetermined length have been formed.

The method described above may be further augmented by:

forming an upper barrier cover over the waste site and interconnecting said barrier cover with the side barriers, said upper barrier cover being of a size sufficient to span all opposing side barrier portions, and securing said upper barrier cover along the continuous upper perimeter of the side barriers to thereby encapsulate the waste site.

Referring now to FIG. 1, a waste site 11 contains drums 13 filled with hazardous waste, both on the surface 15 and buried deep under the ground 17. Contaminants 19, leaking from the drums 13, threaten to migrate into a water table 12.

Figure 2:
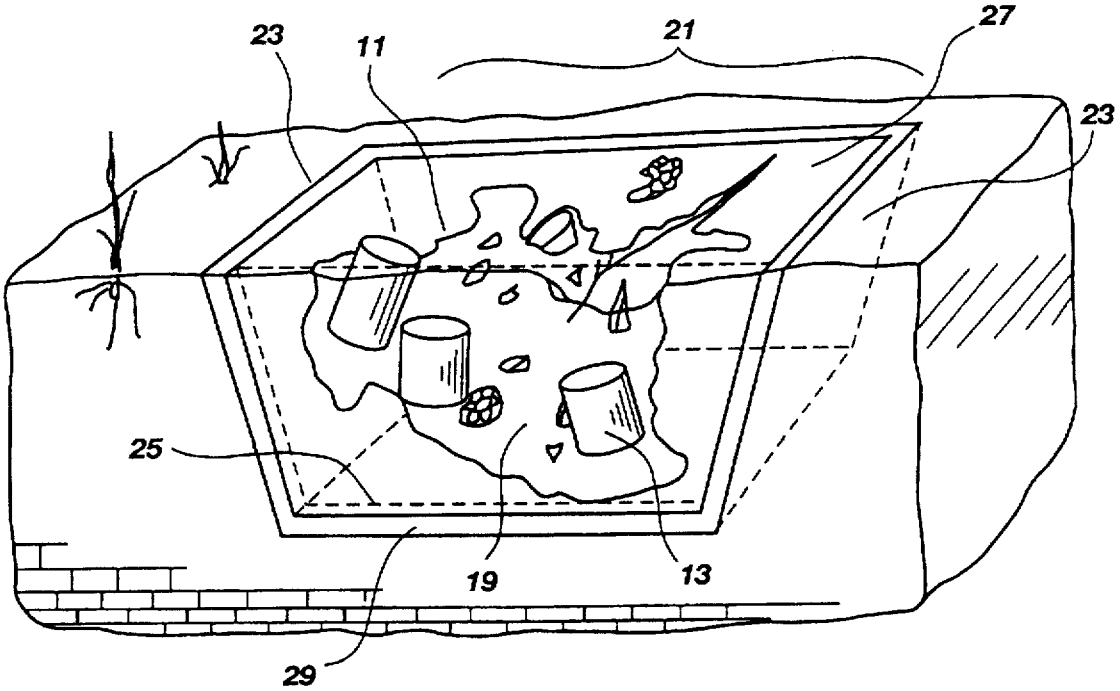
FIG. 2 is a perspective view of the piece of ground with the hazardous waste contained by a protective ground barrier.
Figure 12:
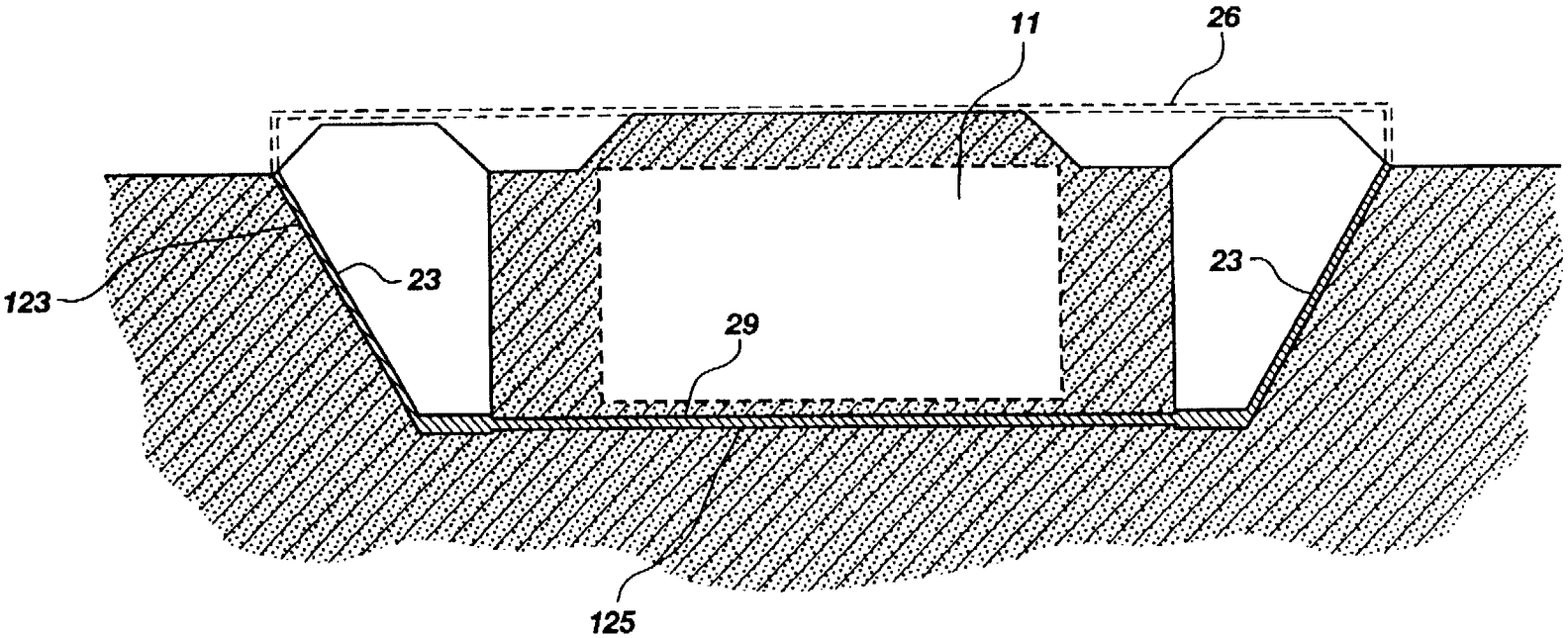
FIG. 12 is a cross-section view of a piece of ground with the hazardous waste contained by one embodiment of a protective ground barrier built by the barrier placement machine.

As shown in FIGS. 2 and 12, this invention provides a way to build a containment barrier 21. This invention places a floor or horizontal barrier 29 without digging up the drums 13 or disturbing the contaminated soil 29. Sides barriers 23 of the containment barrier may be made using conventional methods and interconnected to the horizontal barrier 29. However, in one embodiment of this invention, the floor 29 and the sides 23 are built simultaneously. The waste site 11 may be completely encapsulated by forming an upper barrier cover 26 (FIG. 12, shown in phantom line) and interconnecting said barrier cover with the side barriers 23 and the front and rear barriers 25 and 27 (front barriers 25 shown in phantom line in FIG. 2).

Figures 3A, 3B:
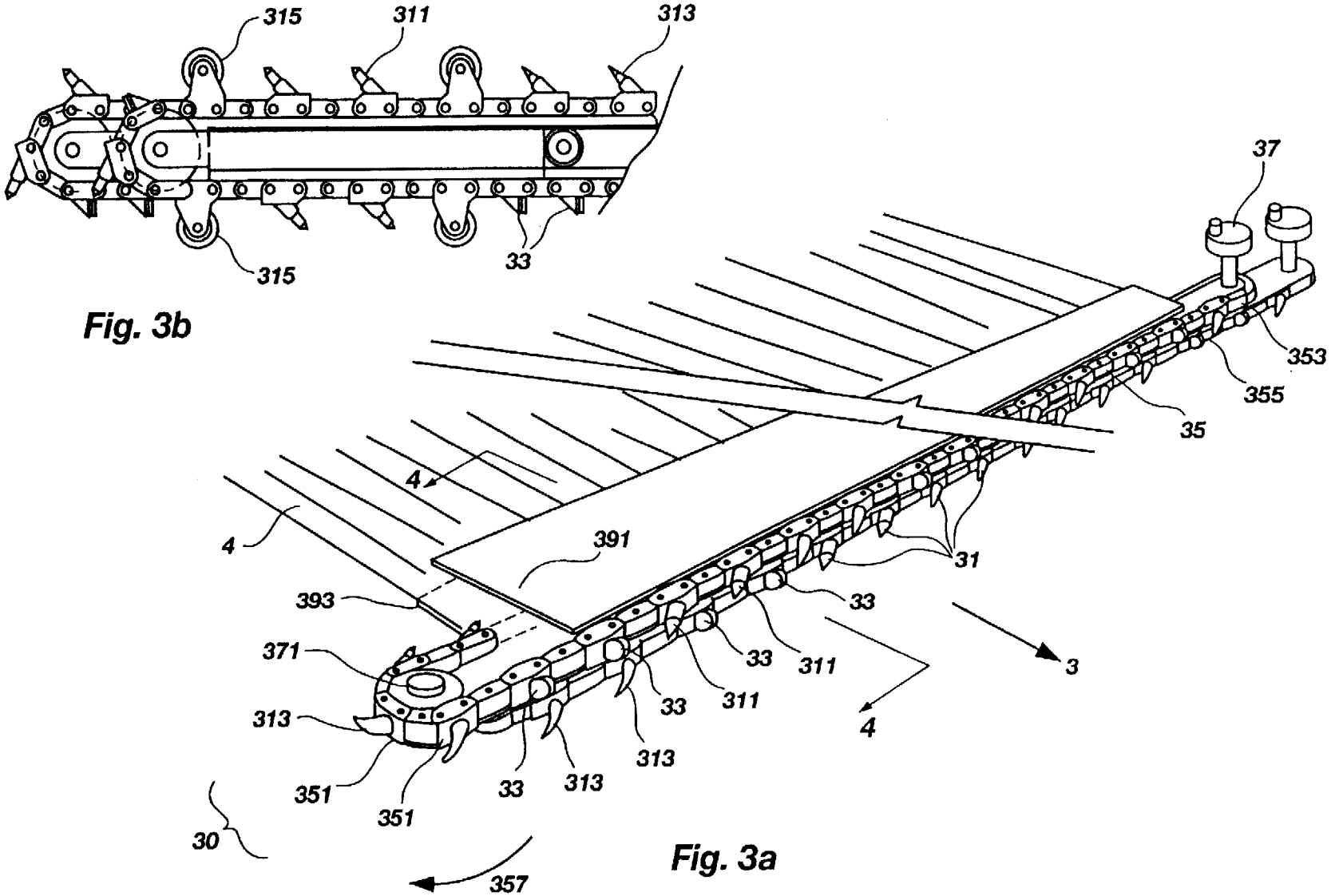
FIG. 3*a* is a perspective view of a cutting chain and grout injector assembly moving through the soil.
FIG. 3*b* is a plan view of the cutting chain showing details of the cutter bits, discharge paddles, and optional rock cutters.

FIG. 3*a* is a perspective view of a cutting chain and grout injector assembly. Cutter teeth 31, such as rock pick cutter bits 311 and space cutter bits 313, are interspersed with discharge paddles 33 on the links 351 of a cutting chain 35. Although FIG. 3 shows two cutting chains, a top chain 353 and bottom chain 355, this invention can comprise only a single chain or several separate chains. In addition, a belt may be used instead of a chain. The cutter teeth 31 may optionally include carbide tips for increased durability.

The cutting chain 35 is held taunt between an idler wheel 371 and a cutter drive 37. The cutter drive 37 moves the chain in the direction 357 shown in FIG. 3, causing the cutter teeth 31 to cut through the soil and the discharge paddles 33 to scoop up the loosened soil, as the cutting chain assembly 30 moves horizontally 3 through the soil. An upper shield 391 and a lower shield 393 maintain the horizontal void 41 (940 in FIG. 9) created by the action of the cutting chain assembly 30 until grout 4 released from a grout injector sufficiently hardens.

FIG. 3*b* shows the details of rock pick cutter bits 311, space cutter bits 313, discharge paddles 33, and an optional rock cutter 315. The rock cutter 315 is for extremely rocky ground. With this combination of cutter bits, the cutting chain assembly and grout injector can cut through soils presently too hard for the prior art. Thus, the cutting chain assembly and grout injector will function in rocky or hard soil, as well as in sandy or soft soil.

Figure 4:
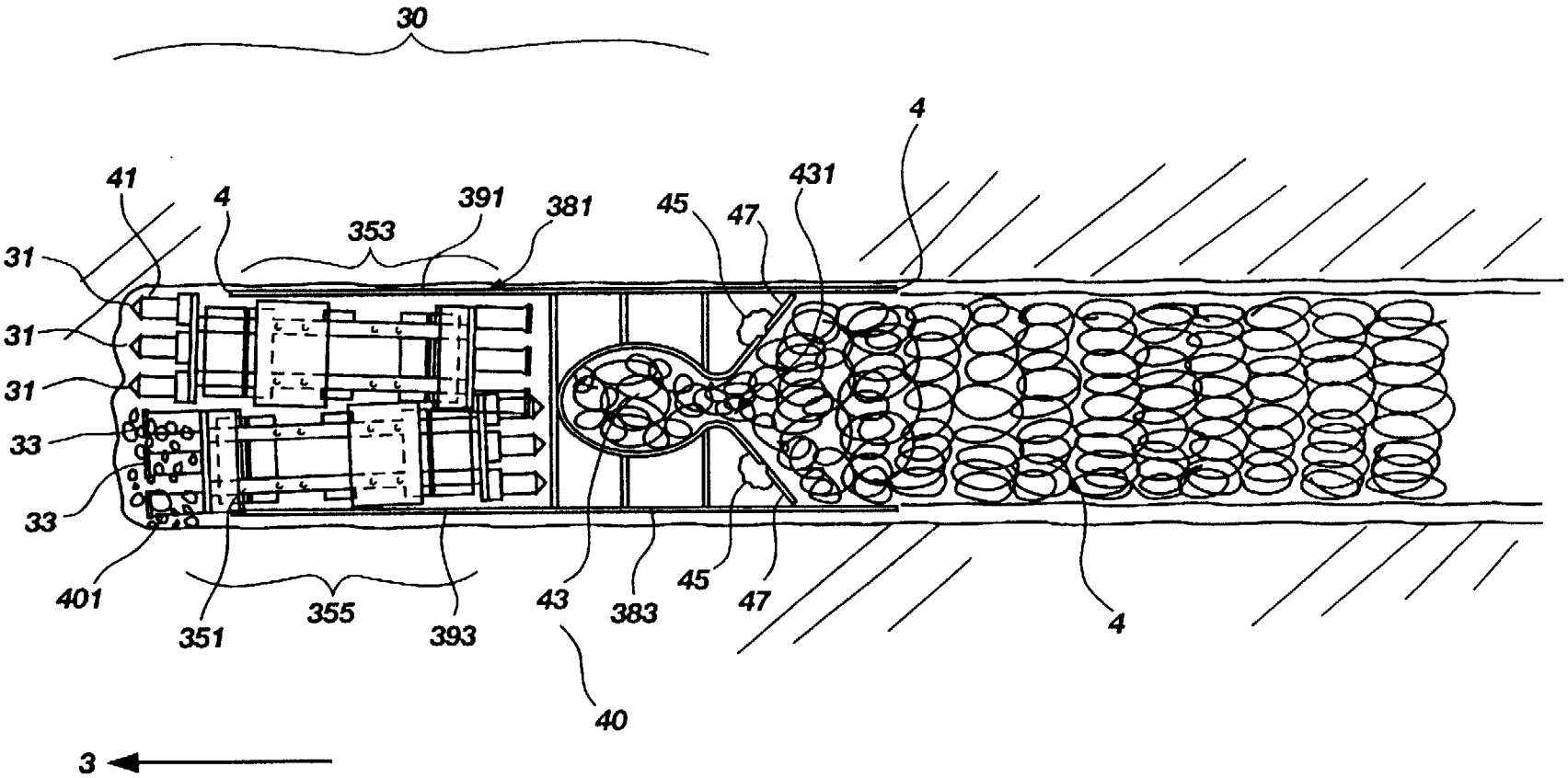
FIG. 4 is a cross-section view of the cutting chain and grout injector machine moving through the soil.

FIG. 4 shows more clearly the action of the cutter chain and grout injector assembly as it moves horizontally 3 through the soil 40. FIG. 4 is a cutaway cross-section view of the cutter chain and grout injector assembly across section 4—4 shown in FIG. 3A. The cutter teeth 31 cut through the soil 40 and the discharge paddles 33 scoop up the loosened soil 401 to create a void 41 in the soil. The upper shield 391 and a lower shield 393 maintain the horizontal void 41 as the grout 4 is discharged into the void.

The upper chain 353 is tilted slightly upwards at the cutting end and the lower chain 355 is tilted slightly downward to make the void 41 slightly larger than the distance between the outer edges 381 and 383 of the horizontal shields 391 and 393. Grout moves through the grout chamber 43, exiting through a continuous slot nozzle 431. A back flow shield 47 keeps the grout from moving forward into the chains 353 and 355. The grout hardens in that portion of the void behind the cutting chain assembly 30.

Pressure transducers 45 measure the pressure of the grout. Feedback from the pressure transducers 45 allows an operator to determine a grout flow rate through the grout chamber 43 and out the continuous slot nozzle 431. The horizontal shields 391, 393, and backflow shields 47, coupled with the pressure transducers 45 and the adjusted grout flow rate, ensure that a structurally strong containment barrier is formed regardless of the soil density or composition encountered by the cutting chain and grout injector assembly.

Although FIGS. 3*a* and 4 show the cutting chain moving horizontally through the soil, this invention is not so limited. The cutting chain could move in a vertical direction up or down through the soil or along any path under soil, including a curved path.

Unlike the Halliburton system discussed above in The Background Art section, because the cutting chain is separate from the grout injection system, only the grout needed for the containment barrier is introduced into the soil. There is less disturbance of the soil and the present invention introduces no excess liquid that may further spread contaminants. Further, different grout compositions may be used as needed to contain different contaminants present in the waste site. However, this invention includes an embodiment where the soil is not removed but mixed directly with the grout. For example in FIGS. 3*a*, 3*b*, and 4, the discharge paddles 33 can be removed so the broken up soil remains in the void 41 created by the cutter teeth 31.

In addition to grout, this assembly may dispense any material that initially flows as a slurry into an open space, yet over time cures into a solid mass having generally the shape of the open space. This includes cement, latex polymer cement, bentonite clay slurry, hot wax, hot asphalt, hot polyethylene, gelled water, or any rubber-like compound. Additionally, the grout itself may contain additional radiation shielding components or biological and chemical neutralizing components.

Another preferred embodiment of this invention allows two or more layers of different materials to be placed simultaneously. For example, another chamber and continuous nozzle below, or above, the grout chamber 43 and continuous slot nozzle 431 in FIG. 4 can dispense a second material. Thus, a layer of material other than grout may be added at the same time as the grout layer. A possible containment barrier produced by this invention would include a cement layer and one or more preferably plastic layers. The cement would provide the strength and support while the plastic would add leak protection, especially if cracks developed in the cement.

Figure 5C:
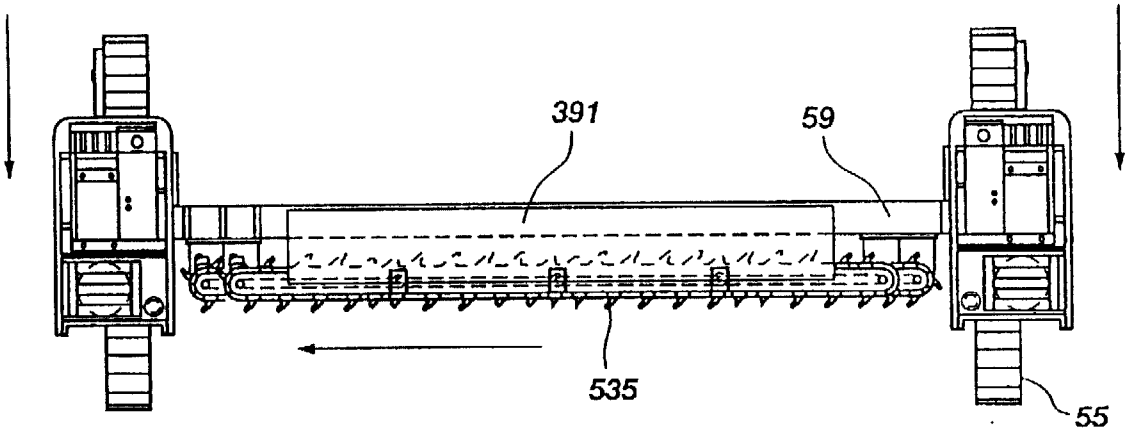
FIG. 5*c* is a plan view of the prototype cutting chain and grout injector machine.
Figure 5A:
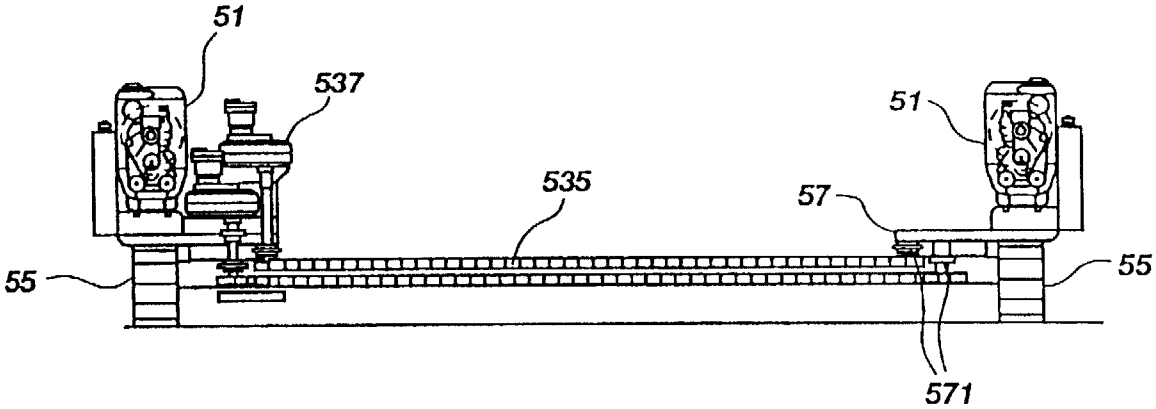
FIG. 5*a* is a front view of a prototype cutting chain and grout injector machine.
Figure 5B:
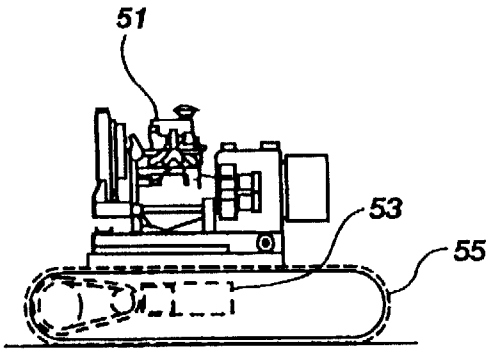
FIG. 5*b* is a side view of the prototype cutting chain and grout injector machine.

FIGS. 5*a*, 5*b*, and 5*c* are three views of a prototype cutting chain and grout injector machine. A carrier frame 59, mounted on a track assembly 55, supports two variable speed cutter drives 537 and two idler wheels 571 mounted on an idler frame 57. Each variable speed cutter drive and idler wheel pair holds a cutter chain 535. Power sources 51 provide power to the cutter chains 54 through the variable speed drives 537, provide pressure to push grout through the grout chamber and out through the continuous slot nozzle, and move the track assembly 55 forward. The grout chamber and the slot nozzle reside beneath the upper shield 391.

Figure 6A:
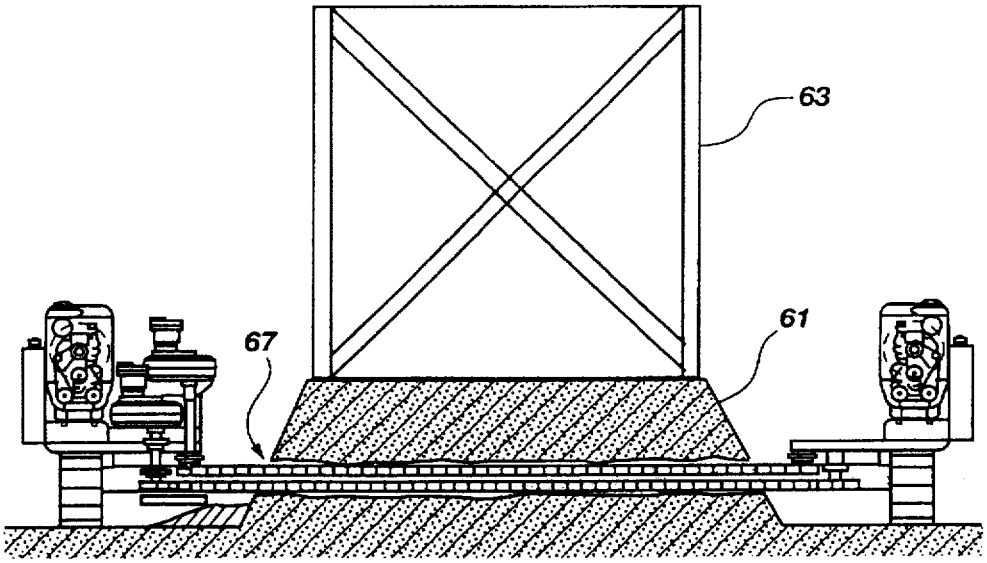
FIG. 6*a* shows the prototype cutting chain and grout injector machine creating a horizontal containment barrier on a test mound.

FIG. 6*a* shows the prototype cutting chain and grout injector machine creating a horizontal containment barrier on a test mound 61. The test mound included three segments designed to simulate typical soils in a hazardous waste site. The first segment consisted of compacted fine materials, the second of compacted 3 inch diameter material, and the third of cemented material ranging from fine to 24 inch basalt. Above all three segments was an overburden containment structure 63 to provide weight on the cutting chain.

The prototype cutting chain and grout injector machine successfully cuts through the three segments of the mound, leaving behind a structurally sound horizontal containment barrier. The invention constitutes a means for building a horizontal containment barrier under a hazardous waste site substantially without disturbing any buried waste. The invention may be constructed to cut successfully through hard or soft soils.

Figure 6B:
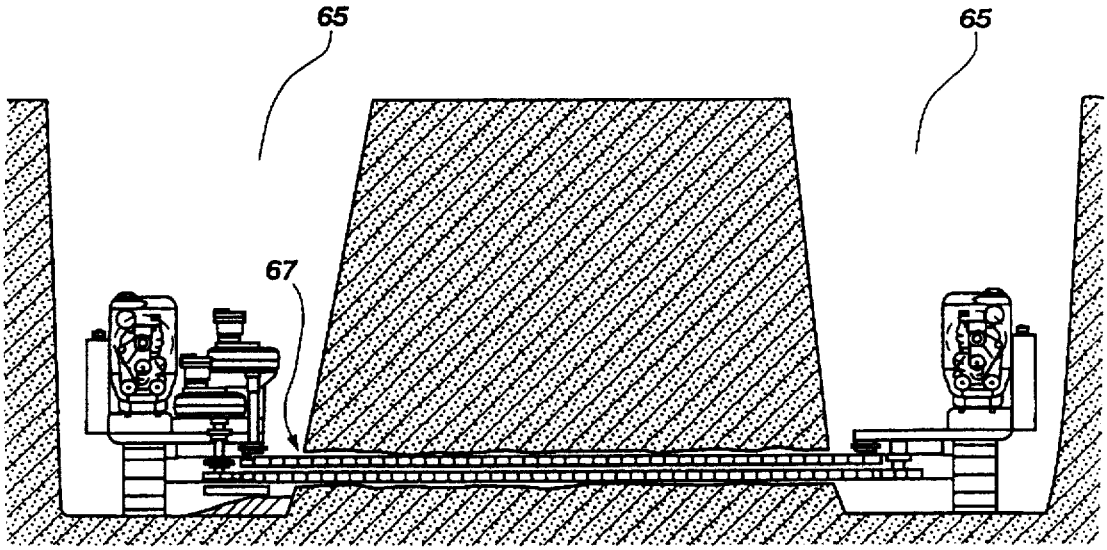
FIG. 6*b* shows the prototype cutting chain and grout injector machine creating a horizontal containment barrier on a small waste site.

The excavated soil is discharged out of the side 67 of the mound as shown in FIGS. 6*a* and 6*b*. This soil can be easily scooped up and tested for contamination or for soil composition. This availability of the excavated soil from the horizontal cut for testing is unique to this invention and is not found in the prior art.

FIG. 6*b* shows the prototype cutting chain and grout injector machine creating a horizontal containment barrier on a plot of ground. The machine is lowered into two side ditches 65. These two side ditches are preferably dug using conventional methods.

Figure 7:
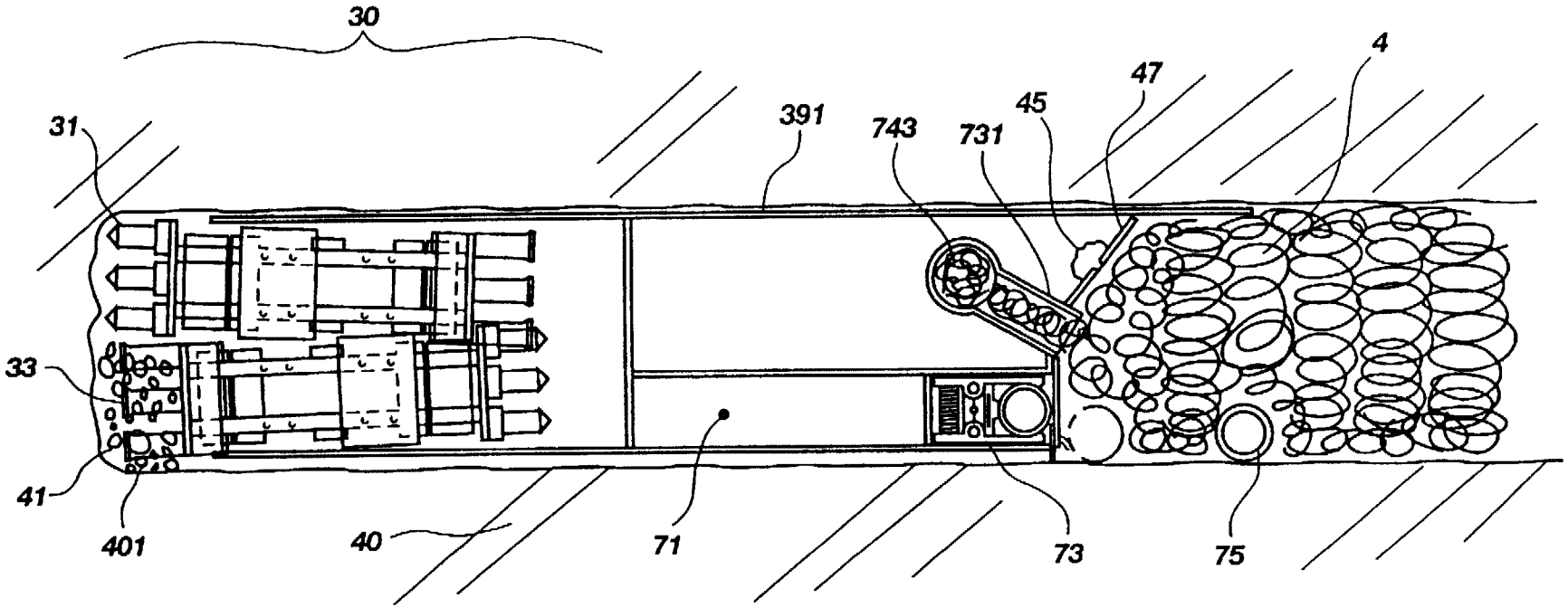
FIG. 7 is a cross-section view of the cutting chain and grout injector assembly with tubing inserter.
Figure 8:
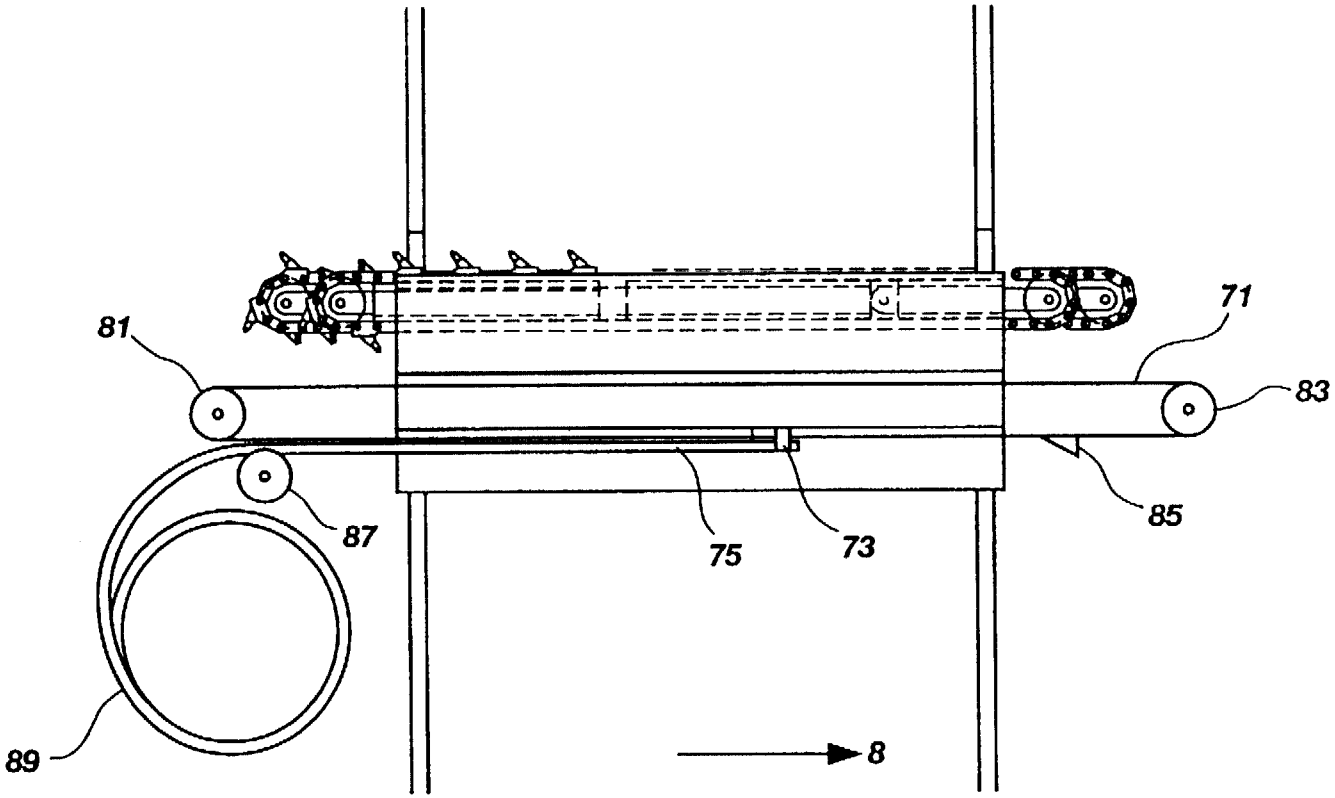
FIG. 8 is a plan view of the cutting chain and grout injector assembly with tubing inserter.

FIG. 7 shows a cross-section view, and FIG. 8 shows a plan view of the cutting chain and grout injector assembly with tube inserter. In FIG. 7, the chain assembly 30 remains as shown in FIG. 4. The cutter teeth 31 cut through the soil 40 and the discharge paddles 35 scoop up the loosened soil 401 to create a void 41 in the soil. The upper horizontal shield 391 maintains the void 41 as the grout 4 is discharged. Grout moves through a grout chamber 743, exiting through a continuous slot nozzle 731. A pressure transducer 45 measures the pressure of the grout and a back flow shield 47 keeps the grout from moving forward.

In addition, a tube inserting system is added as shown in FIGS. 7 and 8. In FIG. 7, tubes 75 are released into the grout 4 by a tube inserter gripper 73. A tube inserter cable 71 pulls the tube inserter gripper 73 under the grout chamber 743.

FIG. 8 shows the operation of the tube inserter cable 71 and the tube inserter gripper 73. A cable drive sheave 81 continuously pulls the tube inserter cable 71 around a cable guide sheave 83. The tube inserter gripper holds the end of the tube, pulling it in the direction 8 shown. When the tube inserter gripper 73 impacts a fixed size release wedge 85, the tube inserter gripper 73 opens to release the tube. The tube inserter gripper 73 remains on the cable to return to a tube guide sheave 87 to pick up a new tube. The tube guide sheave 87 feeds uncut tubing from a tubing reel 89. Although FIGS. 7 and 8 show the tube 75 as PVC pipe, a similar technique can be used to place rebar or other strengthening material to the grout. This is unique as the prior art known to applicants has no provisions for strengthening material to the containment barrier.

Figure 9:
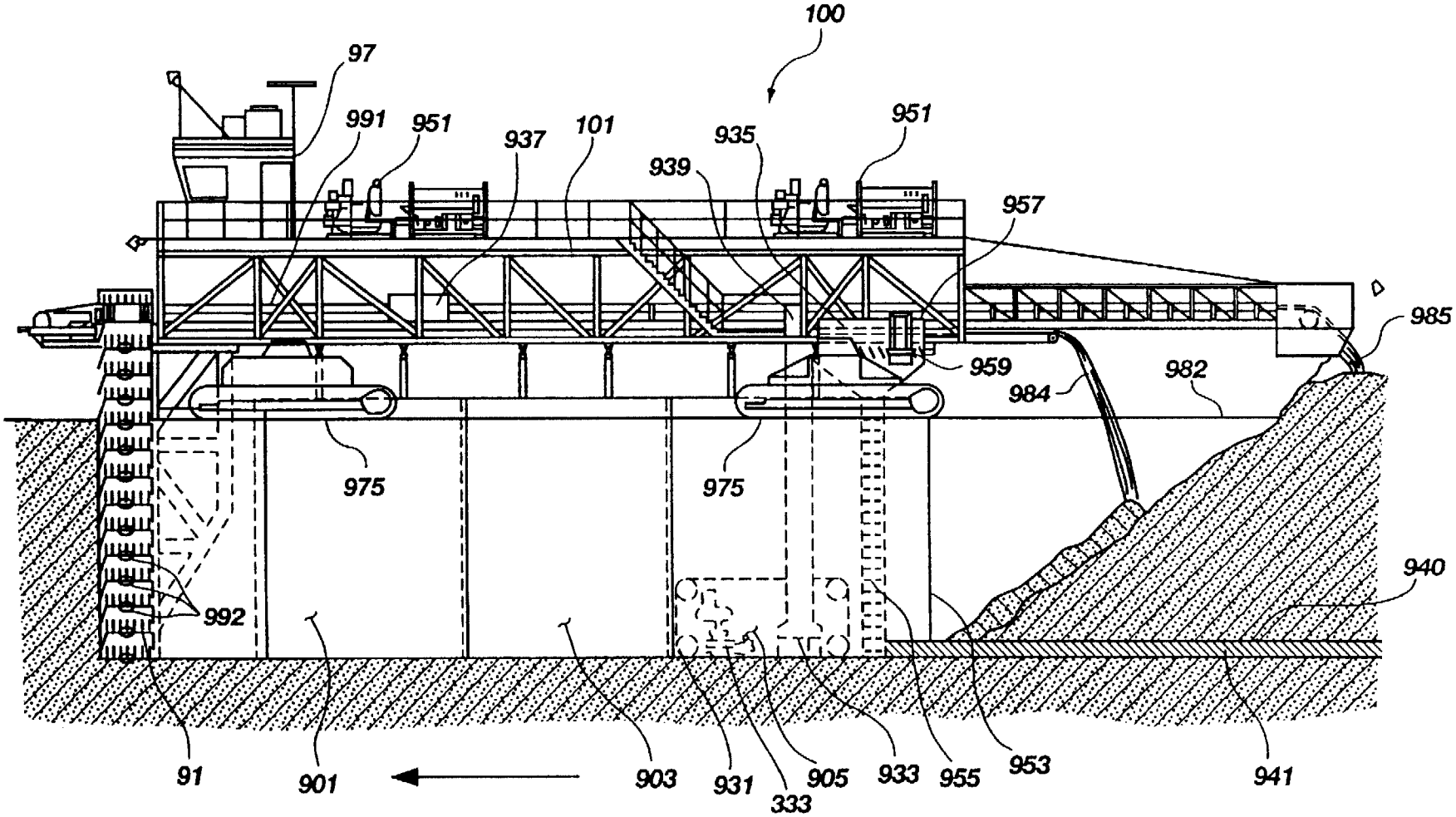
FIG. 9 is a side view of a preferred embodiment of the present invention, a barrier placement machine.
Figure 10:
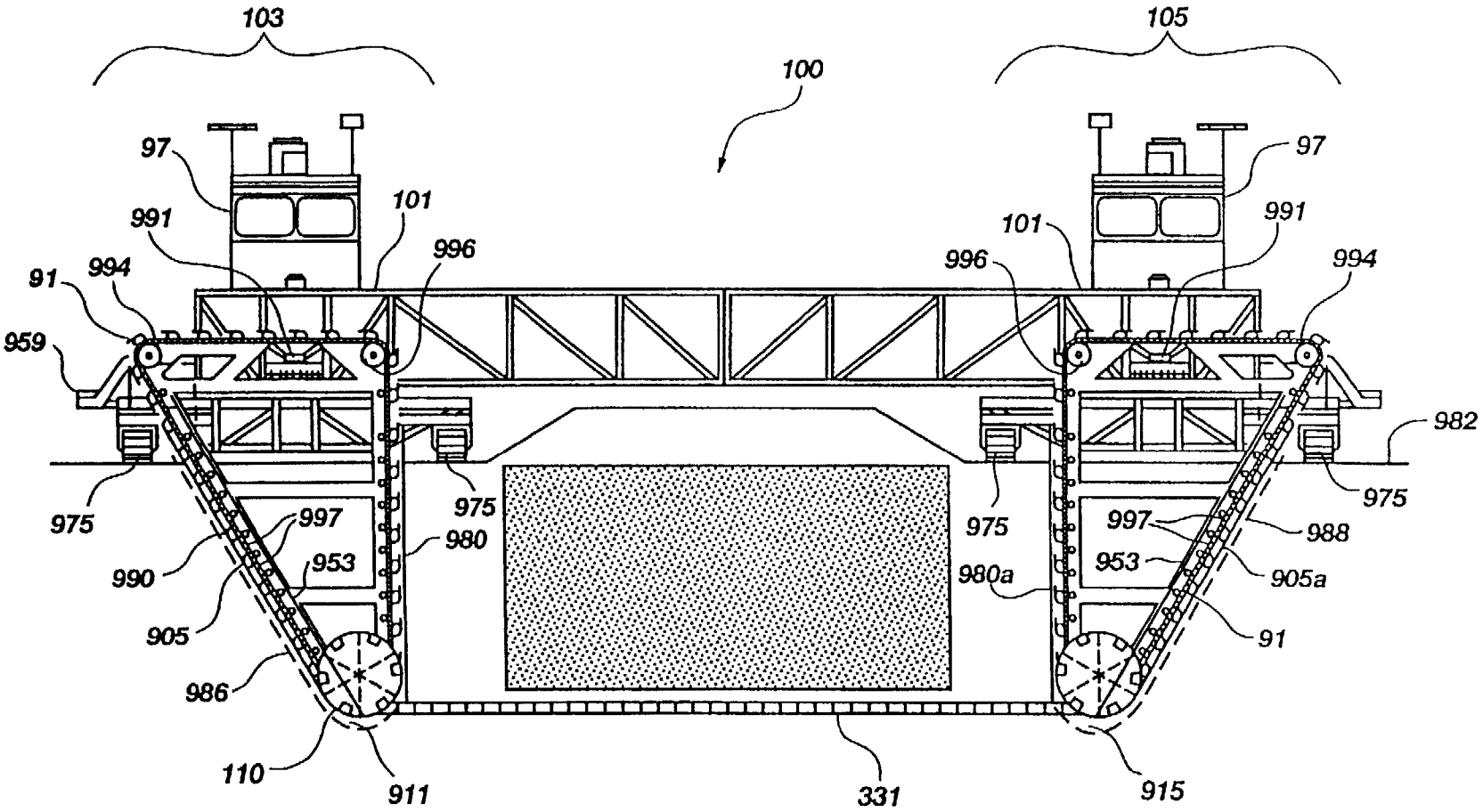
FIG. 10 is a front view of the barrier placement machine.
Figure 11:
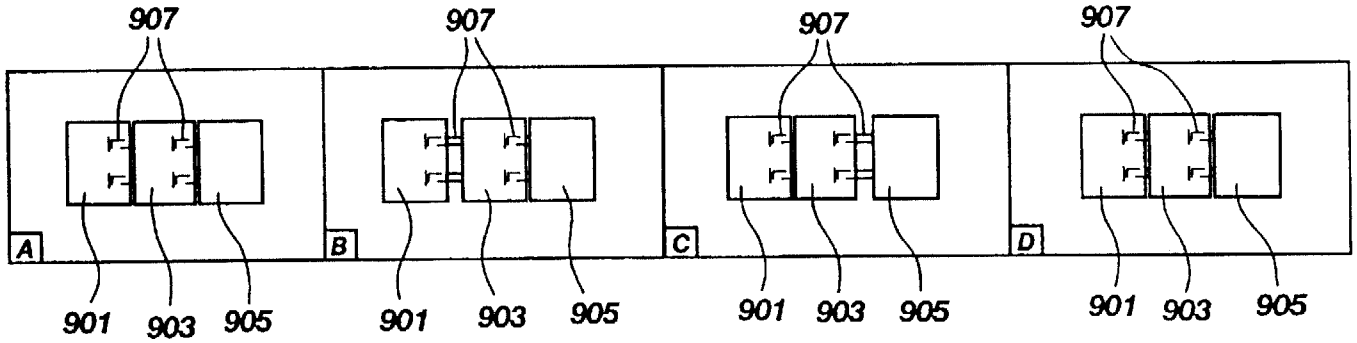
FIG. 11 shows the sequence of steps in the operation of individually moveable shields for reinforcing excavated side trenches against collapse.

FIG. 9 is a side view, and FIG. 10 is a front view, of a barrier placement machine, another preferred embodiment of this invention in the form of an apparatus 100 for constructing an underground barrier. The barrier placement machine digs side trenches and builds the side walls 23 (FIG. 11) of the protective ground barrier while simultaneously building the horizontal floor of the protective ground barrier. Movable tracks 975 support and move the barrier placement machine. As the barrier placement machine moves forward, a trench excavator 91 digs a side trench while a horizontal cutting chain and grout injector assemble 333 digs a horizontal trench. The trench excavator 91 carries the excavated soil 984 up out of the ground and dumps it on the trench excavator conveyor 991 while a soil transfer conveyor 931 and vertical screw conveyor 933 move the soil 985 excavated by the assembly 333 upwardly and deliver the soil 985 to a slot cutter discharge conveyor 935. Excavated soil assay equipment 937 tests the soil for contaminates as the soil 984 moves along the trench excavator conveyor 991. Referring to FIGS. 9–11 and as explained below, grout is channeled and placed sequentially along an outer boundary of the trench (and atop the horizontal barrier 29 which is being formed by the assembly 333) to form the vertical wall 23, after which the soil 984 and 985 is dumped to refill the side trench and support the newly-formed vertical wall 23. Therefore, the preferred sequence for applying grout to the side trenches in conjunction with the trench cutting operation is that soil 984 is first excavated by the trench excavator 91 to form the side trench, then the grout is placed to form the vertical wall 23, after which soil 984 is dumped to refill the trench. More specifically, once the wall 23 is newly formed, trench excavator conveyor dumps the soil 984 behind the barrier placement machine 100, refilling the trench and thereby preventing collapse of the newly-formed vertical wall 23, and the discharge conveyor 935 follows by dumping the soil 985 atop the dumped soil 984.

First side shield 901, second side shield 903, and third side shield 905 support the sides of the excavated trench so the trench does not collapse. The cutting chain and grout injector assembly 333, described in FIGS. 3*a* and 3*b* above, excavates horizontal underground trench 940 and constructs therein the horizontal grout barrier 941. The cutting chain and grout injector assembly 333 is located behind the third movable side shield 905. A soil transfer conveyor 931 moves the soil evacuated by the cutting chain to a vertical screw conveyor 933. The vertical screw conveyor 933 lifts this soil out of the trench to a slot cutter discharge conveyor 935. A second array of excavated soil assay equipment 939 tests the soil from the horizontal cut for contaminates as the soil moves along the slot cutter discharge 935. The slot cutter discharge conveyor 935 moves the soil to the rear of the barrier placement machine and dumps it back into the trench.

A grout hopper with pug mill 957 mounted on top of the barrier placement machine prepares grout. Some grout moves to the grout injector in the cutting chain and grout injector assembly 333, while the rest of the grout moves along a grout receiving conveyor 959 to a slip form traveling pan 953. The slip form travel pan 953 channels and holds the grout into the trench into a slip form consolidator 955 where the grout is shaped into a vertical wall 23 (shown most clearly in FIG. 11). For example, as understood by those of ordinary skill in the art, the slip form travel pan 953 holds the newly-delivered grout in vertical formation while the slip form consolidator 955 vibrates the grout to consolidate it properly. The machine 100 moves along slowly to permit the grout wall 23 to cure sufficiently before the pan 953 moves away from the cured section to form the next portion of the wall 23.

An operator's cab 97 protects the driver. Power sources 951 power the trench excavator 91, the cutting chain and grout injector assembly 333, the soil conveyors 931, 933, 935, 991, the grout conveyors 959, the grout hopper with pug mill 957, and track 975 means for moving the entire apparatus 100.

FIG. 10 is a front view of the barrier placement machine. A main frame support structure 101 holds a left barrier placement machine 103 a fixed distance from a right barrier placement machine 105, thus holding the chain 331 of the cutting chain and grout injector assembly 333 taut between them. An optional rock cutter wheel 110 cuts through the bottom of the trenches.

Referring now to FIGS. 9–11, applicants note that the reinforcing side shields 901, 903 and 905 are preferably moveable relative to the support structure 101. FIG. 10 illustrates an additional plurality of reinforcing side shields 980 disposed opposite the side shields 901, 903 and 905, preferably in like number and operation, such that both opposing sides of the left trench 911 are reinforced as the apparatus 100 progresses. Arrays of side shields are disposed on the right side of the apparatus 100 in similar number and configuration, as indicated at 905*a* and 980*a*, respectively, for reinforcing both opposing sides of the right trench 915.

In broad terms, the apparatus 100 comprises the following:

the support structure 101;

the track advancing means 975 attached to the support structure 101 for advancing the support structure along a surface 982;

excavating means 91 attached to the support structure 101 for excavating earthen material 984 and simultaneously forming first and second underground side trenches 911 and 915 defined by opposing earthen sidewalls as the support structure 101 is advanced along the surface 982 by the advancing means 975;

barrier-forming means 957 attached to the support structure 101 for forming first and second side barriers (shown in phantom schematic at 986 and 988, respectively) within the first and second underground side trenches 911 and 915; and shield means (901, 903 and 905) attached to the support structure for (i) moving along at least one of the earthen sidewalls (for example, 990) of one of the underground trenches (for example, 911) as the support structure 101 advances along the surface 982 and (ii) providing lateral support to said earthen sidewall 990.

The excavating means 91 preferably comprises:

at least first and second endless chains 994;

first and second chain driving means 996 for advancing the first and second chains, respectively, in continuous orbital movement;

a plurality of digging teeth 997 disposed on the chains 994; and a plurality of excavation vessels 992 (see FIG. 9) disposed on the chains 994.

The horizontal trench excavating and grouting assembly 333 discharges earthen material from the excavation of horizontal trench 940 to a conveyor system which discharges that earthen material 985 above ground as shown in FIG. 9 where it lies conveniently accessible for testing is desired.

Figure 10A:
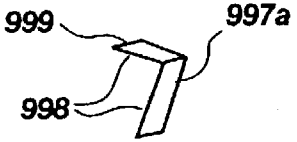
FIG. 10A is a schematic view of a bi-directional digging tooth of the barrier placement machine of FIG. 10.

The digging teeth 997 preferably comprise bi-directional digging teeth, as represented schematically in FIG. 10A at 997*a*. Each bi-directional digging tooth 997*a* comprises a first digging surface 998 and a second digging surface 999 disposed in a substantial perpendicular orientation with respect to at least a portion of the first digging surface 998. In the view of the earthen sidewall 990 in FIG. 10, the first digging surface 998 would excavate into that earthen sidewall 990 while the second digging surface 999 excavate forwardly, i.e. into the page of FIG. 10. Any suitable bi-directional digging tooth capable of digging in two separate directions is within the scope of the present invention.

FIG. 11 shows the sequence of operation steps for the retaining side shields, depicting the plurality of side shields 901, 903 and 905 by illustration. The other side shield arrays work in identical operation as that of the shields 901, 903 and 905. The shield array 901, 903 and 905 is described as a first plurality of sequentially-moveable shields, 980 corresponds to a rear view of a similar, second plurality of sequentially-moveable shields, while 905*a* and 980*a* depict a rear view of third and fourth pluralities of sequentially-moveable shields, respectively.

Moving means 907 are disposed on the first plurality of side shields for sequentially moving said first plurality of shields, one at a time, in a direction toward the excavating means 91 and away from the barrier-forming means 955/957. The moving means 907 may comprise hydraulically-actuated cylinders or any other suitable means for moving the shields. The side shields thus move incrementally in the manner of an inch worm. In step A, the beginning position of a movement cycle is depicted. In step B, the first shield 901 is advanced forwardly, introducing a gap between it and the second shield 903. In step C, the second shield 903 is advanced forwardly and again into position adjacent the first shield 901, closing the gap while producing another gap, this time between the second shield 903 and third shield 905. In step D, the third shield 905 is moved forwardly and again into position adjacent the second shield 903 such that the gaps are closed and the shields are again substantially a single shield member.

The shield movements described above preferably depict movement of the shields with respect to the support structure 101. In such case the support structure 101 could be then advanced forwardly between each movement cycle (i.e. all of the steps A–D in FIG. 11 depict a single movement cycle) while all shields 901, 903 and 905 remain stationary with respect to the forwardly advancing support structure 101, often another movement cycle of the shields begins.

The shields are preferably positioned in a substantial parallel orientation relative to the trench sidewalls. As shown in FIG. 10, the left and right side trenches 911 and 915 each comprise a generally vertical sidewall and an opposing slanted sidewall disposed at an acute angle with respect to the vertical sidewall. Although the shields 901, 903 and 905, and corresponding shield arrays 980, 905*a* and 980*a*, are preferably moveable relative to the support structure 101, side shields may be constructed which are fixedly attached to the support structure 101 and which are therefore confined to forward movement with said support structure 101, if desired.

FIG. 12 shows a cross-section view of the contained hazardous waste site across the 11—11 line in FIG. 11. Grout side walls 123 and a grout floor 125 enclose the hazardous waste.

It is to be understood that the inventive combinations described herein are applicable to a wide variety of uses. The inventive concepts of excavating surrounding trenches around an in-situ waste site without removing the waste site, and forming barriers within the trenches without relying on the native soil to form the barrier material, are broadly applicable. These concepts may be used in building construction, canal construction, leach mining and tunnel construction, in various applicable ways understandable to those of ordinary skill in the art. The concepts herein may also be used as a secondary containment system to surround an existing containment structure such as an underground tank. They could further be used to create a subjacent reinforcing barrier beneath a building foundation, or to repair a leaking pond or channel. The installation and reinforcement of pipe may also be served by the invention combinations described herein. A containment well barrier could also be formed with the concepts of the present disclosure.

The phrase "in-situ" as used herein shall be broadly construed to refer to objects or cumulations of objects which remain situated in their original position. The adjective "earthen", as used herein in phrases such as "earthen material" or "earthen sidewalls", shall be construed broadly herein to refer to anything composed of earth, including, but not limited to, soil, rock, gravel, clay, dirt, sand and the like.

It is also to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

We claim:

1. An apparatus for constructing an underground barrier comprising:

a support structure;

advancing means attached to the support structure for advancing said support structure along a surface;

excavating means attached to the support structure for excavating earthen material and simultaneously forming first and second underground side trenches defined by opposing earthen sidewalls as the support structure is advanced along the surface by the advancing means;

barrier-forming means attached to the support structure for forming first and second side barriers within the first and second underground side trenches; and shield means attached to the support structure for (i) moving along at least one of the earthen sidewalls of one of the underground trenches as the support structure advances along the surface and (ii) providing lateral support to said earthen sidewall.

2. The apparatus as defined in claim 1:

wherein the excavating means further comprises horizontally-disposed means for excavating earthen material from beneath an in-situ portion of earth without substantial disturbance of said in-situ portion and thereby forming a generally horizontal underground trench defined by opposing earthen sidewalls;

wherein the barrier-forming means includes means for forming a generally horizontal barrier within the generally horizontal trench.

3. The apparatus as defined in claim 2, wherein the excavating means further comprises means for excavating the earthen material in a manner such that the first and second side trenches are disposed in communication with the generally horizontal trench, and wherein the barrier-forming means further comprises means for simultaneously interforming the horizontal barrier with the first and second side barriers such that said horizontal and side barriers cooperatively form a one-piece, three-sided unitary barrier.

4. The apparatus as defined in claim 2, further comprising:

second shield means attached to the horizontally-disposed excavating means for (i) moving along at least one of the earthen sidewalls of the horizontal trench as the support structure advances along the surface and (ii) providing support to said earthen sidewall.

5. The apparatus as defined in claim 4, wherein the second shield means comprises upper and lower horizontally-disposed shields coupled to the horizontally-disposed excavating means and extending outwardly therefrom.

6. The apparatus as defined in claim 5, wherein the upper and lower shields are fixedly coupled to the horizontally-disposed excavating means.

7. The apparatus as defined in claim 1, wherein the barrier-forming means comprises means for forming barriers within the trenches substantially without any intermixing of in-situ earthen material with material of the barriers.

8. The apparatus as defined in claim 1, wherein the barrier-forming means comprises injecting means for injecting fluidic barrier-forming material into the first and second underground trenches.

9. The apparatus as defined in claim 1, wherein the excavating means comprises:

at least first and second endless chains; and first and second chain driving means for advancing the first and second chains, respectively, in continuous orbital movement.

10. The apparatus as defined in claim 9, further comprising:

a plurality of digging teeth disposed on the chains; and a plurality of excavation vessels disposed on the chains.

11. The apparatus as defined in claim 10, wherein the digging teeth further comprise bi-directional digging teeth.

12. The apparatus as defined in claim 11, wherein each bi-directional digging tooth comprises a first digging surface and a second digging surface disposed in a substantial perpendicular orientation with respect to at least a portion of the first digging surface.

13. An apparatus for constructing an underground barrier comprising:

a support structure having front, central and rear portions; advancing means attached to the support structure for advancing said support structure along a surface;

excavating means attached to the front portion of the support structure and extending downwardly therefrom for excavating earthen material and simultaneously forming left and right underground side trenches defined by opposing earthen sidewalls as the support structure is advanced along the surface by the advancing means;

barrier-forming means attached to the rear portion of the support structure for forming first and second side barriers within the left and right underground trenches; and shield means movably disposed on the central portion of the support structure for (i) moving relative to the support structure within one of the underground trenches and along at least one of the earthen sidewalls defining said underground trench in a direction toward the excavating means and away from the barrier-forming means, and (ii) providing lateral support to said earthen sidewall at a portion of the underground trench within which a barrier portion has not yet been formed by the barrier-forming means.

14. The apparatus as defined in claim 13, wherein the support structure includes left and right sides, the shield means comprising:

a left plurality of sequentially-moveable shields movably disposed on the left side of the support structure;

left moving means disposed on the left plurality of shields for sequentially moving the shields of said left plurality, one at a time, in a direction toward the excavating means and away from the barrier-forming means;

a right plurality of sequentially-moveable shields movably disposed on the right side of the support structure;

second moving means disposed on the right plurality of shields for sequentially moving the shields of said right plurality, one at a time, in a direction toward the excavating means and away from the barrier-forming means.

15. The apparatus as defined in claim 13, wherein the support structure includes left and right sides, the shield means comprising:

first and second pluralities of sequentially-moveable shields movably disposed on the left side of the support structure;

first and second moving means disposed on the first and second pluralities of shields, respectively, for sequentially moving the shields of said first plurality, one at a time, in a direction toward the excavating means and away from the barrier-forming means, and for sequentially moving the shields of said second plurality, one at a time, in a direction toward the excavating means and away from the barrier-forming means;

third and fourth pluralities of sequentially-moveable shields movably disposed on the right side of the support structure; and third and fourth moving means disposed on the third and fourth pluralities of shields, respectively, for sequentially moving the shields of said third plurality, one at a time, in a direction toward the excavating means and away from the barrier-forming means, and for sequentially moving the shields of said fourth plurality, one at a time, in a direction toward the excavating means and away from the barrier-forming means.

16. The apparatus as defined in claim 13, wherein the excavating means includes means for forming the first and second underground side trenches such that each side trench is defined by a generally vertical sidewall and an opposing slanted sidewall disposed at an acute angle with respect to the vertical sidewall.

17. The apparatus as defined in claim 16, wherein the support structure includes left and right sides, the shield means comprising:

first and second pluralities of sequentially-moveable shields movably disposed on the left side of the support structure, said first plurality being disposed in a generally vertical orientation and said second plurality being disposed at an acute angle with respect to the first plurality in a configuration and spacing sufficient to enable said first and second pluralities of shields to contactably abut the vertical and slanted sidewalls of the left side trench, respectively;

first and second moving means disposed on the first and second pluralities of shields, respectively, for sequentially moving the shields of said first plurality, one at a time, in a direction toward the excavating means and away from the barrier-forming means, and for sequentially moving the shields of said second plurality, one at a time, in a direction toward the excavating means and away from the barrier-forming means;

third and fourth pluralities of sequentially-moveable shields movably disposed on the right side of the support structure, said third plurality being disposed in a generally vertical orientation and said fourth plurality being disposed at an acute angle with respect to the third plurality in a configuration and spacing sufficient to enable said third and fourth pluralities of shields to contactably abut the vertical and slanted sidewalls of the right side trench, respectively; and third and fourth moving means disposed on the third and fourth pluralities of shields, respectively, for sequentially moving the shields of said third plurality, one at a time, in a direction toward the excavating means and away from the barrier-forming means, and for sequentially moving the shields of said fourth plurality, one at a time, in a direction toward the excavating means and away from the barrier-forming means.

18. The apparatus as defined in claim 13, wherein the barriers comprise means for resisting radiation.

19. An apparatus for constructing an underground barrier comprising:

a support structure;

advancing means attached to the support structure for advancing said support structure along a surface;

excavating means attached to the support structure for simultaneously (i) excavating earthen material and thereby forming an open trench defined by opposing earthen sidewalls as the support structure is advanced along the surface by the advancing means, and (ii) excavating earthen material from beneath an in-situ portion of earth without substantial disturbance of said in-situ portion and thereby forming a generally horizontal trench defined by opposing earthen sidewalls;

barrier-forming means attached to the support structure for simultaneously forming a side barrier within the open trench and a generally horizontal barrier within the generally horizontal trench; and shield means attached to the support structure for (i) moving along at least one of the earthen sidewalls of the open trench as the support structure advances along the surface and (ii) providing lateral support to said earthen sidewall.

* * * * *